US009700927B2

(12) United States Patent
Krause et al.

(10) Patent No.: US 9,700,927 B2
(45) Date of Patent: Jul. 11, 2017

(54) APPARATUS FOR TRANSFERRING WORKPIECES

(71) Applicant: Strothmann Machines & Handling GmbH, Schloss Holte-Stukenbrock (DE)

(72) Inventors: Mathias Krause, Spenge (DE); Joerg Rosenhaeger, Bielefeld (DE); Markus Wesling-Schaefers, Geseke (DE)

(73) Assignee: STROTHMANN MACHINES & HANDLING GMBH, Schloss Holte-Stukenbrock (DE)

( * ) Notice: Subject to any disclaimer, the term of this patent is extended or adjusted under 35 U.S.C. 154(b) by 0 days.

(21) Appl. No.: 14/941,602

(22) Filed: Nov. 15, 2015

(65) Prior Publication Data

US 2016/0144420 A1 May 26, 2016

(30) Foreign Application Priority Data

Nov. 20, 2014 (DE) ..... 10 2014 117 026

(51) Int. Cl.

| | |
|---|---|
| ***B21D 43/10*** | (2006.01) |
| ***B23Q 7/04*** | (2006.01) |
| ***B65G 47/14*** | (2006.01) |
| ***B21D 43/05*** | (2006.01) |

(52) U.S. Cl.

CPC ..... *B21D 43/05* (2013.01); *B21D 43/052* (2013.01); *B21D 43/055* (2013.01); *B21D 43/105* (2013.01)

(58) Field of Classification Search

CPC ..... B65G 47/14; B21D 43/10; B23Q 7/04

USPC ..... 198/468.2, 468.4, 750.12

See application file for complete search history.

(56) References Cited

U.S. PATENT DOCUMENTS

| | | | | |
|---|---|---|---|---|
| 5,257,899 | A * | 11/1993 | Asakura | B21D 43/055 198/468.4 |
| 5,919,024 | A * | 7/1999 | Fujimori | G01R 31/01 198/468.4 |
| 6,109,423 | A * | 8/2000 | Moriyasu | B21D 43/05 198/468.01 |
| 6,131,721 | A * | 10/2000 | Arakawa | H01L 21/67706 198/468.3 |
| 6,179,547 | B1 * | 1/2001 | Hayakawa | B23Q 7/04 198/468.4 |
| 6,382,400 | B1 * | 5/2002 | Hofele | B65G 17/26 198/626.1 |
| 6,543,604 | B1 * | 4/2003 | Pung | B65G 57/04 198/468.4 |

(Continued)

FOREIGN PATENT DOCUMENTS

DE 202012104324 U 1/2013

*Primary Examiner* — Douglas Hess

(74) *Attorney, Agent, or Firm* — Andrew Wilford

(57) ABSTRACT

An apparatus for moving a workpiece in a press installation has a transfer bar extending along a longitudinal bar axis and having longitudinally opposite bar ends. A plurality of tool assemblies on the transfer bar are adapted to grip and hold the workpiece; A pair of stationary frames spaced apart along a Y axis generally parallel to the bar axis are juxtaposed with the bar ends and longitudinally flank the bar. A pair of X slides are each displaceable in a horizontal X direction perpendicular to the Y axis on a respective one of the frames. Respective primary mounts on the X slides each carry a respective end of the bar with the bar longitudinally movable in each of the primary mounts.

16 Claims, 5 Drawing Sheets

(56) References Cited

U.S. PATENT DOCUMENTS

| | | | | |
|---|---|---|---|---|
| 6,554,120 | B2 * | 4/2003 | Okachi | B21D 43/00 198/341.01 |
| 7,068,763 | B2 * | 6/2006 | Burrell | H04L 12/66 379/100.15 |
| 7,124,616 | B2 * | 10/2006 | Kawamoto | B21D 43/055 198/621.1 |
| 7,410,046 | B2 * | 8/2008 | Shiroza | B21D 43/10 198/468.4 |
| 7,415,759 | B2 * | 8/2008 | Vischer | H01L 21/67144 198/468.4 |
| 7,624,614 | B2 * | 12/2009 | Heid | B21D 43/05 72/405.13 |
| 7,690,238 | B2 * | 4/2010 | Shiroza | B21D 43/055 72/405.11 |
| 7,841,073 | B2 * | 11/2010 | Mitsumochi | H05K 13/0452 198/428 |
| 7,861,850 | B2 * | 1/2011 | Musha | G02F 1/13452 198/460.2 |
| 7,971,468 | B2 * | 7/2011 | Coalson | B21D 26/023 198/621.1 |
| 8,141,922 | B2 * | 3/2012 | Shim | H01L 21/6838 294/65 |
| 8,162,128 | B2 * | 4/2012 | Kimura | H05K 13/0452 198/468.3 |
| 8,272,244 | B2 * | 9/2012 | Hoffman | B21D 28/265 413/62 |
| 8,430,006 | B2 * | 4/2013 | Stanojevic | B26D 1/553 414/749.1 |
| 8,857,239 | B2 * | 10/2014 | Nishida | B21D 43/055 198/621.1 |

* cited by examiner

APPARATUS FOR TRANSFERRING WORKPIECES

FIELD OF THE INVENTION

The present invention relates to an apparatus for transferring workpieces between work stations in a manufacturing or treatment plant. More particularly this invention concerns such a transfer apparatus used for transferring sheet-metal workpieces between presses.

BACKGROUND OF THE INVENTION

An apparatus for transporting workpieces within a press installation, in particular for transporting vehicle body parts within a press installation for the automobile industry typically has at least one transfer bar extending along a longitudinal bar axis extending generally parallel to a horizontal Y axis, to which bar one or more tool assemblies, for example gripper arms, are attached or can be attached. The transfer bar is seated at its two ends in respective X slides that can move along a horizontal transfer or X axis, and the bar can also preferably be raised and lowered along a vertical Z axis.

This type of transfer apparatus is employed in practical applications in press installations or press lines such as, for example in the automobile industry. In this way, workpieces, for example vehicle body parts, can be transported for example within a press line from one press or press stage to the next press or press stage, or from one treatment apparatus to a downstream treatment apparatus. An essential component of a transfer apparatus is the transfer bar to which typically a plurality of tool assemblies, for example gripper arms, are attached that can be equipped with suction bars so that the transfer bar as a whole can also be identified as a suction bar and is equipped with appropriate negative-pressure vacuum connections. The transfer bar can typically be moved and/or rotated in various directions, thereby enabling the transfer to be flexible. Multiple gripper arms are preferably interconnected through common connecting tubes so as to create the tool assembly, which is also identified as a suction spider and can in its entirety comprise multiple suction cups.

DE 20 2012 104 324 discloses a transfer apparatus of the above-described type in which the transfer bar is provided so as to be longitudinally modifiable and is composed of a first bar section and a second bar section that can each be displaced relative to each other along the longitudinal bar axis, and the first bar section movably fits within a female end of the second bar section through by a male end. The known transfer apparatus has a compact structure and allows for very flexible transfer of the workpiece while simultaneously providing high stability. Using the fundamentally known approach, the transfer bar can be moved by headpieces or X slides along the transfer X axis, while provision is also made whereby the transfer bar can be raised and lowered along the vertical Z axis. The two headpieces can optionally be moved relative to each other and thus along the Y axis, with the result that the length of the transfer bar is changed and thus changes the positions where grippers are attached to the transfer bar. The two halves of the transfer apparatus can also be moved in different ways from each other since the longitudinally movable transfer bar enables variations in length to be compensated for. While these known measures have proven successful in practice, it is still possible to develop them further.

In addition, U.S. Pat. No. 7,624,614 describes a transfer apparatus in which a vertical slide is held such that it can be raised and lowered by spindles along vertical supports. This vertical slide carries longitudinal supports that extend along the transfer axis and are also held such that they can be raised and lowered and also rotated about a horizontal axis. A transfer bar is held on these horizontal supports so as to be movable and also rotatable.

OBJECTS OF THE INVENTION

It is therefore an object of the present invention to provide an improved apparatus for transferring workpieces.

Another object is the provision of such an improved apparatus for transferring workpieces that overcomes the above-given disadvantages, in particular that is characterized by high flexibility and optimized transport speed along with a simple and compact construction.

SUMMARY OF THE INVENTION

An apparatus for moving a workpiece in a press installation has according to the invention a transfer bar extending along a longitudinal bar axis and having longitudinally opposite bar ends. A plurality of tool assemblies on the transfer bar are adapted to grip and hold the workpiece; A pair of stationary frames spaced apart along a Y axis generally parallel to the bar axis are juxtaposed with the bar ends and longitudinally flank the bar. A pair of X slides are each displaceable in a horizontal X direction perpendicular to the Y axis on a respective one of the frames. Respective primary mounts on the X slides each carry a respective end of the bar with the bar longitudinally movable in each of the primary mounts.

Thus with this invention the transfer bar in a generic transfer apparatus of the above-described type can be moved or displaced relative to the X slides along the longitudinal bar axis generally parallel to the Y axis. An especially preferred aspect of the invention is the fact that the transfer bar is a non-telescoping thus rigid bar that has a fixed predetermined and fixed set bar length when operating. The transfer bar is preferably held at the ends on Y slides that are movable on the X slides along the longitudinal bar axis generally parallel to the Y axis. An especially advantageous approach is for Y actuators to be attached to the X slides so that they act on the transfer bar or the Y slides along the longitudinal bar axis. According to the invention, these Y actuators are, for example piston/cylinder units, especially preferably as pneumatic piston/cylinder units.

The movability of the transfer bar along the longitudinal bar axis provides the ability to compensate for a wide variety of angular positions on the part of the transfer bar relative to the Y axis during operation without requiring a telescoping transfer bar. Compensation of these angular positions can in principle be effected actively by appropriately controlling the Y actuators. However the preferred approach is to effect compensation passively by providing the Y actuators as piston/cylinder units, for example pneumatic piston/cylinder units. It is thus possible to lock one of these pneumatic cylinders as the fixed bearing side in a predetermined functional position and leave the other pneumatic cylinder "free" as a floating bearing. Compensation of the angular positions is consequently effected not by adjusting the length of the bear itself but by the pneumatic cylinders using a variable "suspension." The design of these pneumatic cylinders can be very simple since they do not have to be actuated to move to a wide variety of positions and consequently do not have to be path-controlled; instead it is sufficient if the pneumatic cylinders can be moved to their defined end positions and can move freely (on the floating bearing side) between these end positions.

A possible alternative or supplemental approach is to use the Y actuators, for example the pneumatic cylinders, to automatically disengage or engage the transfer bar. To accomplish this, the transfer bar is interchangeably attached to the Y slides or alternatively also to the X slides through releasable bar couplings. Each of these bar couplings includes a frame-side socket element and a bar-side plug element that engage each other during the coupling action. This can be effected by operating the Y actuators since this allows the socket elements to move into the plug elements along the Y axis. The Y actuators, which are preferably pneumatic, thus have both a compensating function during operation as well as a coupling and decoupling function. The Y actuators can furthermore be used during startup to adjust to the specific press geometry for purposes of a "zero adjustment."

An especially interesting aspect is the fact that it is possible to utilize standard coupling elements according to the invention, for example quick couplings that are also used for robots, for example articulated-arm robots. The couplings used according to the invention can especially preferably be unlocked and locked pneumatically. This means that pneumatic locking and unlocking are possible independently from the pneumatically actuated engagement and disengagement of the ends. The coupling elements thus include locking elements that can be appropriately operated radially of the bar axis. This pneumatic locking and unlocking function is available in conventional standard couplings and these can be utilized according to the invention.

Another especially important aspect of the invention is the fact that the transfer bar can be moved or controlled to move in many different directions of motion, thereby providing a wide range in the degrees of freedom available. To this end the transfer bar, for example is attached so as to be rotatable about the bar axis, for example rotatable about the bar axis on the Y slide. To accomplish this, a separate drive is preferably provided for the rotational motion about the bar axis. In an alternative and supplemental approach the transfer bar can be linked cardanically to the Y slide so as to implement two additional directions of rotation. It is thus possible to implement rotation about a vertical axis and about a horizontal axis. This can be accomplished by attaching a housing to the Y slide that is preferably rotatably attached to the Y slide about a vertical axis, and the transfer bar is rotatably held in/on the receiving housing about the bar axis. This housing can be composed, for example of a primary outer housing and a secondary inner housing, the outer primary housing being rotatable one of the Y slides about the vertical axis, and the inner secondary housing is held on the outer primary housing for rotation relative thereto about the horizontal axis. Here the transfer bar is then rotatably held in/on the secondary housing for rotation about the bar axis. In overall terms, a wide variety of degrees of freedom can be provided in very compact form without impairing the variability of the installation.

In the basically known approach, the transfer apparatus furthermore comprises the two vertical frames with a vertically movable Z slide being guided on each of these frames. The X slides already mentioned above can then be movably guided on the Z slide along the X axis. What is preferably provided according to the invention is that a first X1 slide can move on the Z slide along the X1 axis and in turn a second X2 slide can move along the X2 axis, the X1 axis and the X2 axis being parallel to each other and to the X axis. The interaction of the X1 slide and the X2 slide enables the transfer apparatus to be operated at especially high speeds while making the optimal use of space.

Especially advantageous here is the fact that two transfer halves arranged mirror symmetrically about a vertical plane in the Y and X directions are provided interconnected through cardanically suspended transfer bars, thus creating the overall transfer apparatus. The transfer halves are especially preferably attached to the press frames of the corresponding press, for example bolted onto the press frames. The invention also includes the approach whereby vertical supports are attached to the front side of each press frame and thus not to the backs.

An especially preferable application of the transfer apparatus according to the invention is in tandem press installations. One transfer apparatus is then provided per press stage to feed the parts between the respective presses of the stage. Another transfer apparatus is also provided at the end of the installation for removing the parts from the last press stage. The transfer apparatus picks up parts, for example vehicle body parts composed for example of sheet steel, and inserts them between the dies of the specific press or press stage. After deforming in the press, the part (from the next transfer direction) is removed in the direction of production (press outfeed) and cycled on to the next press stage or set down at the installation outfeed section.

The construction of the transfer apparatus is especially compact and easily accessible. This is because the invention provides the ability to install all of the modules above the floor. Neither compensation tanks for hydraulic mass balancing nor supply lines has to be placed in the press foundation. This significantly shortens the amount of time spent on maintenance work. The space thus available is used during tool changes to move the tool assemblies by tool carts automatically to the delivery position. The transfer apparatus according to the invention can perform flexible orientation procedures. The required movements are made possible by the four driven linear axes and one driven rotational axis. The parts are transported from one press stage to the next. The last transfer deposits the finished parts directly on the discharge conveyor belt.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
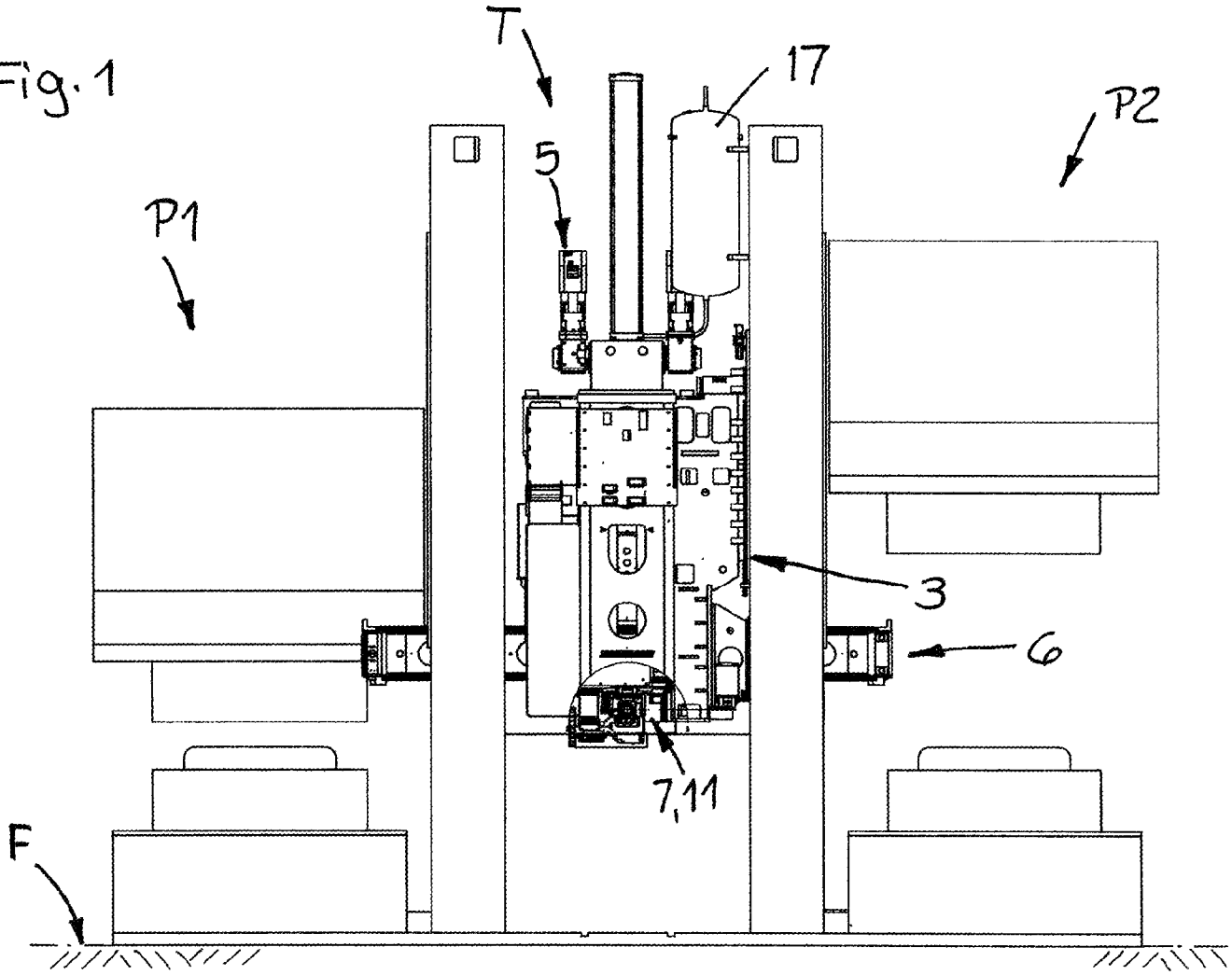
FIG. 1 is a simplified side view of a press installation with the transfer apparatus according to the invention.
Figure 2:
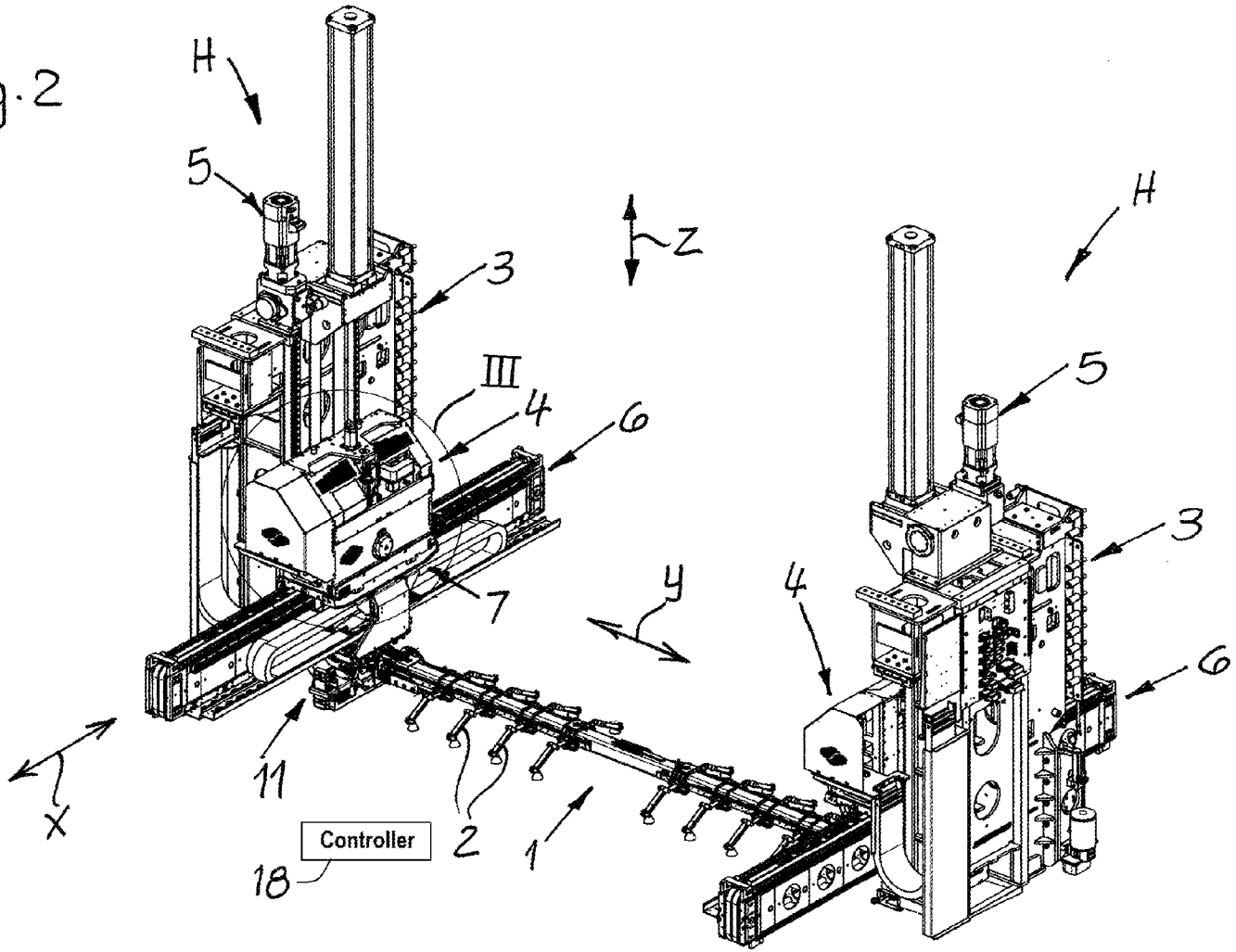
FIG. 2 is a perspective view of a single transfer apparatus according to the invention between two presses of a pressing stage.
Figure 5:
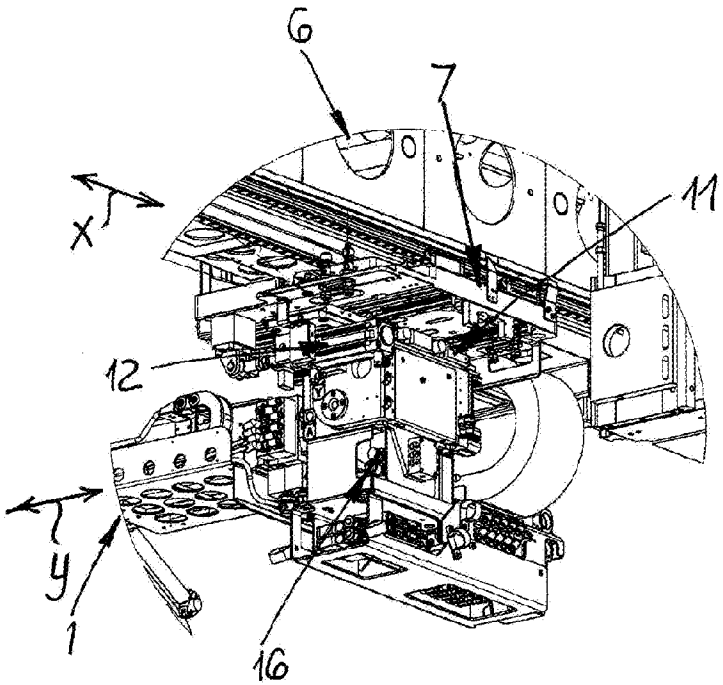
FIG. 5 is an enlarged detail indicated at V in FIG. 4.
Figure 3:
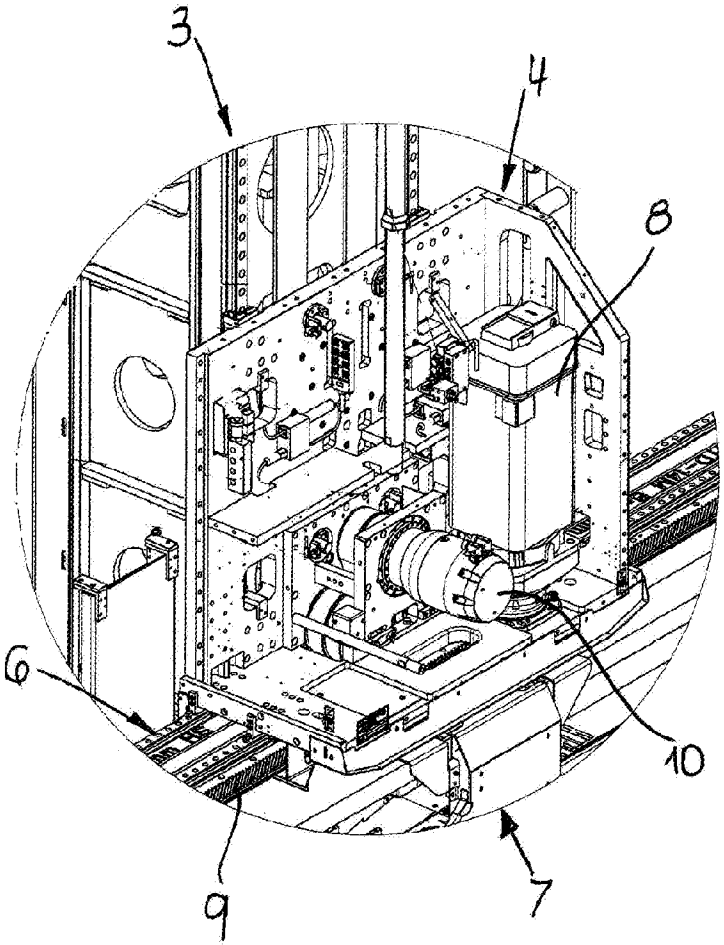
FIG. 3 is a large-scale view of the detail indicated at III in FIG. 2.
Figure 4:
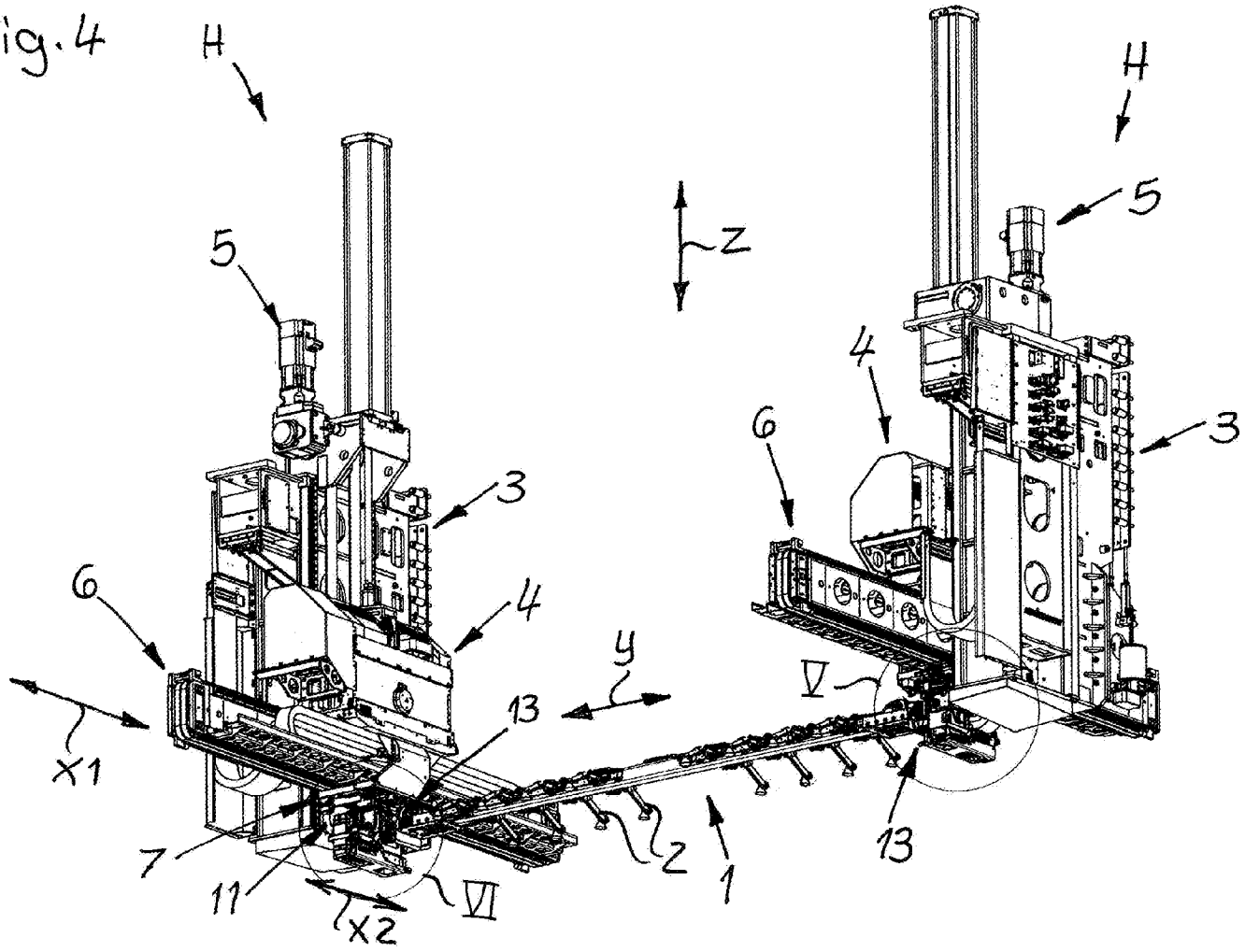
FIG. 4 is another view of the object in FIG. 2.
Figure 7:
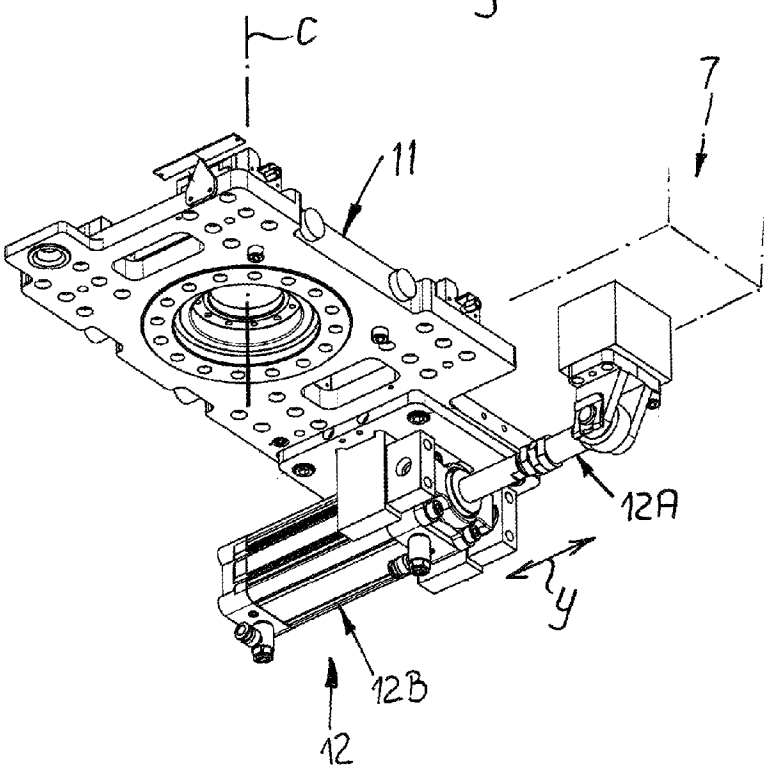
FIG. 7 is an enlarged view of the Y adjuster.

As seen in the drawing a transfer apparatus T moves workpieces (for example vehicle body parts or panels) in a press installation. FIG. 1 shows a detail of a press installation comprising a press stage having two presses P1 and P2 and the transfer apparatus T, whereas FIGS. 2 through 7 show only the transfer apparatus T and the presses P1 and P2 are not shown in these views. This type of transfer apparatus T is generally employed in a tandem press installation where one transfer apparatus is used for a press stage including two presses as shown at P1 and P2, although each stage could have two such apparatuses T.

The transfer apparatus T includes a transfer bar 1 extending along and defining a horizontal and longitudinal bar axis B (see FIG. 6) generally parallel to a horizontal Y axis and multiple tool assemblies in the form of gripper arms 2 attached to the transfer bar 1. The gripper arms 2 are equipped with grabs here formed by suction devices that can pick up, hold, and release the unillustrated workpiece. The bar 1 can be moved with various degrees of freedom, thereby enabling a wide variety of workpieces to be variably transported. To this end, the transfer apparatus T is here composed of two mirror-symmetrical transfer halves H and the transfer bar 1 that is cardanically suspended between these transfer halves H, with the result that both transfer halves H and the interposed transfer bar 1, which is also known as a suction bar, constitute the complete transfer apparatus T for high-speed transfer.

Each transfer half H includes a vertical frame 3 that essentially forms the base of the respective transfer half H. These vertical frames 3 are preferably fixed to the confronting front faces of the respective presses P1 and P2. Each frame 3 carries vertical guide rails on which a vertically displaceable Z slide 4 of the respective apparatus half H can move along a vertical Z axis. A Z drive 5 is provided on each frame 3 to move the respective Z slide 4 vertically. This Z drive 5 in the illustrated embodiment is fixed to the respective vertical frame 3 and coupled to the respective Z slide 4 by a belt 4.

At least one X slide movable along the X axis is carried on each of the vertically movable Z slides 4. Here, two separate X slides are provided, namely a primary X1 slide 6 and a secondary X2 slide 7. The primary X1 slide can move horizontally along the X1 axis on the vertically movable Z slide 4. To do this, an X1 drive 8 is attached to the Z slide 4 and has a drive gear meshing with a toothed rack 9 fixed on the X1 slide 6. The X2 slide 7 is horizontally movable on the X1 slide 6 along the X2 axis, and the X1 axis and the X2 axis are horizontal and parallel to each other and to the X axis. The X2 slide 7 here can be moved by a separate X2 drive 10 carried on the X1 slide and coupled to the X2 slide 7 by a belt.

The transfer bar 1 is secured at each end to a respective one of the X2 slides 7, so that movement of the transfer bar 1 can be effected in various different axes relative to the X2 slide 7.

What is especially significant to the invention is that the transfer bar 1 can be moved relative to the X2 slide 7 along its longitudinal bar axis Y. For this purpose each end of the transfer bar 1 is connected to a respective Y slide 11 that is movable on the respective X2 slide 7 along the longitudinal bar axis Y. Y actuators 12 are carried on the X2 slides 7 and are coupled to the Y slide 11 connected to the transfer bar 1 to move it along its longitudinal bar axis Y. Another important aspect is that these Y actuators 12 are not servo drives, like the other drives, but instead are piston/cylinder units and specifically here are of an especially advantageous design as pneumatic piston/cylinder units. To this end here the piston rod 12A is connected to the X2 slide 7, while the cylinder 12B is connected to the plate forming the respective Y slide 11, with the result that the Y slide 11 is moved along the Y axis relative to the X2 slide plate 7 by operating cylinder 12. All of these drives and actuatore are operated synchronously by a controller 18 shown schematically in FIG. 2.

Operation of the pneumatic Y actuators 12 first of all plays an important role during engagement and disengagement of the transfer bar 1. This is because the transfer bar 1 is releasably connected to the Y slides 11 by releasable couplings 13. Both bar couplings 13 each have for this purpose a slide-side coupling element 13A and a bar-side coupling element 13B (see detail in FIG. 6), where these two coupling elements 13A, 13B engage each other when pushed together along the longitudinal bar axis B. Here, the socket 13A on the slide 11 fits with the plug 13B on the bar 1. The reverse is also possible, however, where the plug 13B is on the slide 11 and the socket 13A is on the bar 1. In any case it is possible by operating the Y drives 12 to advance the sockets 13A connected thereto along the Bar axis B, thereby engaging and disengaging the transfer bar 1. Provision is furthermore made whereby the coupling elements 13A, 13B can be locked or unlocked. Locking elements 14 that can be operated radially are provided for this purpose, which elements can also be operated pneumatically. The invention utilizes standard couplings here that are also employed, for example for changing robot tools. Only the socket 13A of the coupling 13 is shown in the upper part of FIG. 6. The transfer bar 1 including plug element 13B connected thereto is not shown in upper [art of FIG. 6 but is seen only in the lower part of this view.

In addition to the function of Y drives 12 to effect engagement and disengagement, these Y drives also have an especially important function in compensating for movement of the transfer bar 1. This is because the transfer bar 1 in the shown embodiment is a rigid and non-telescoping bar (when in operation) with a fixed predetermined length. Compensation of motion as transfer halves H move is thus effected in the shown embodiment not by any telescoping motion by the transfer bar 1 itself but by the fact that movement along the Bar axis B is enabled and allowed by both Y drives 12. Very simple pneumatic actuators 12 can be used for this purpose that are not actuated so as to move away but instead are simply moved by pneumatic actuation either to one of their two end positions or are "allowed to move freely" so that they can move passively between their two end positions without any pneumatic actuation. The one Y drive in the shown embodiment is moved in fixed fashion to an end position acting as a fixed bearing, while the other Y drive can allow free motions along the Bar axis B between the two end positions. This approach allows the transfer bar 1 to follow movement of the two transfer halves H, and specifically whenever the various slides of transfer halves H move in different ways. Various different angular positions, in particular, are possible for the transfer bar 1 without the length of the transfer bar 1 itself changing. This is achieved during operation by the Y drives 12 that essentially operate passively. In addition to the compensating function and the coupling function, these Y drives perform yet another function in connection with adapting the press geometry during initial operation since these Y drives can assist in setting the relevant zero point. Since the system uses a non-telescoping bar and since one of the Y drives creates the fixed side and the other creates the floating side, the tool-assembly center point at different angular positions moves away from the tool-assembly center and this aspect must be taken into account at the tool table or press table. This kind of slight offset is acceptable, however.

It may also be necessary to move or "spread" individual gripper arms 2 relative to each other or on the suction bar 1. Since the suction bar 1 itself here is of fixed length and cannot telescope, it is useful in this case to provide additional drives on the suction bar 1 that can move the gripper arms 2 along the Bar axis B relative to the suction bar 1. They are not shown in detail in the drawing but they can also be pneumatic drives.

Figure 6:
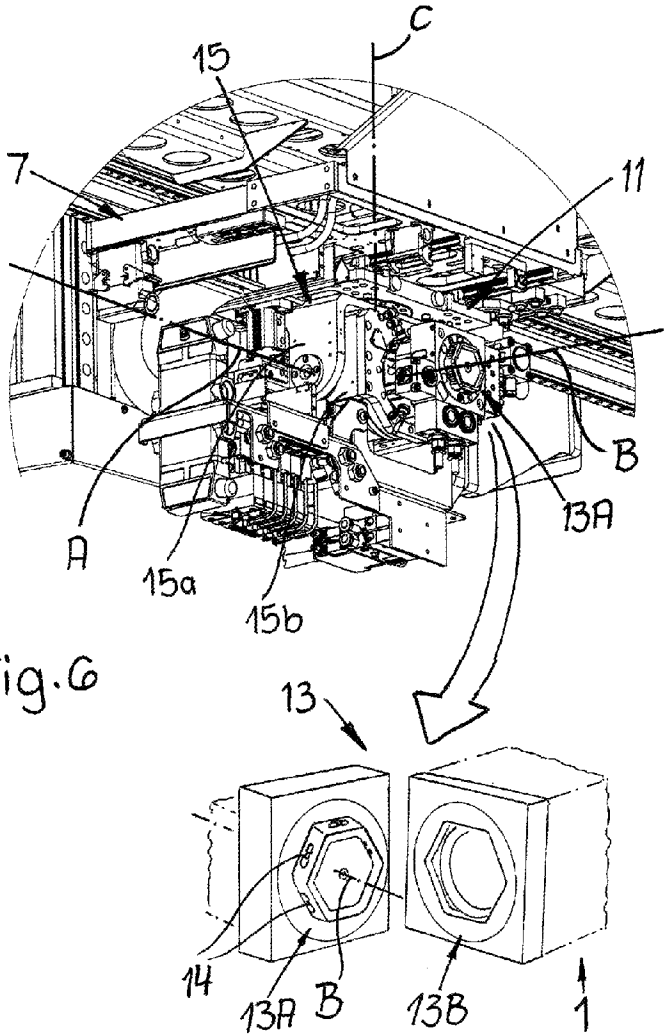
FIG. 6 is an enlarged detail indicated at VI in FIG. 4.

Another especially important aspect is that the transfer bar 1 can be moved relative to the Y slide with various degrees of freedom. To this end the transfer bar 1 is articulated on the Y slide so as to rotate about a bar center axis B and is furthermore also cardanically coupled to the Y slide. Details are shown in FIG. 6. A respective housing 15 is mounted on each Y slide 11 for rotation about a vertical axis C fixed on the respective Y slide 11. The housing 15 is composed for this purpose of an outer housing 15A and inner housing 15B, the outer housing 15A is pivoted on the Y slide 11 for rotation the C axis. The inner housing 15B is rotatable on the outer housing 15A about a horizontal axis A. The transfer bar 1 is in turn rotatably about the B axis on in the inner housing 15B, specifically with coupling 13 being interposed. The rotational motions about the C axis and about the A axis occur passively creating a cardanic suspension. The rotation about the B axis is actively controlled by B drive 16 that can also be a servo drive.

As a result, four servo drives in total are provided for each transfer half H—specifically, the Z drive, the X1 drive, the X2 drive, and the B drive. This provides the straight-line movement along the X, Y, and Z axis, and rotation about the axes A, B, and C, that is a total of six degrees of freedom. Pneumatic drives 12 for the Y axis perform—aside from the coupling function—only a passive function in terms of compensation during operation.

The illustrated transfer apparatus T not only provides very fast transfer, its construction is also very compact and the individual components are readily accessible. An especially important aspect is that all modules are installed above the floor F (FIG. 1) and no components have to be located in the press foundation. The drawing thus shows, for example that even compensation tanks 17, which are provided for hydraulic mass compensation, are disposed on the vertical frames 3 and thus above the press floor F. Reference is thus made here to FIG. 1 that provides a simplified side view of a transfer apparatus installed on the press frame including the compensation tank 17.

The fact that all modules are installed above the floor F, and neither compensation tank 17 nor cylinders and supply lines have to be located in the press foundation, enables maintenance to be simplified and in particular reduces expenditure in terms of time. The components are readily accessible and this in turn shortens the time spent on maintenance work. The space made available thereby is used, for example to automatically move the tool carts into the delivery position during tool changes.

The transfer bar 1 can furthermore be fabricated out of CFRP by the generally known approach. The bar here can be rotated up to 6° about the A axis and by up to 180° about the B axis.

We claim:

1. An apparatus for moving a workpiece in a press installation, the apparatus comprising:

a transfer bar extending along a longitudinal bar axis and having longitudinally opposite bar ends;

a plurality of tool assemblies on the transfer bar and adapted to grip and hold the workpiece;

a pair of stationary frames spaced apart along a Y axis generally parallel to the bar axis, juxtaposed with the ends, and longitudinally flanking the bar;

a pair of X slides each displaceable in a horizontal X direction perpendicular to the Y axis and each on a respective one of the frames; and respective primary mounts on the X slides and each carrying a respective end of the bar with the bar being longitudinally movable at each of its ends in the respective primary mount.

2. The apparatus defined in claim 1, wherein the transfer bar is of fixed length measured from end to end.

3. The apparatus defined in claim 1, further comprising:

a pair of Y slides each fixed longitudinally to a respective bar end and slidable along the bar axis in the respective X slide.

4. The apparatus defined in claim 1, wherein each X slide includes a primary X slide movable along the X axis on the respective frame and secondary X slide movable along the X axis on the respective primary X slide, the secondary X slide carrying the respective primary mount.

5. The apparatus defined in claim 4, further comprising:

respective primary X drives between each primary X slide and the respective frame; and respective secondary X drives between each secondary X slide and the respective primary X slide.

6. The apparatus defined in claim 1, further comprising:

means for shifting the tool assemblies longitudinally along the transfer bar.

7. The apparatus defined in claim 1, wherein the press installation has two presses spaced apart along the Y axis and flanking the transfer apparatus.

8. An apparatus for moving a workpiece in a press installation, the apparatus comprising:

a transfer bar extending along a longitudinal bar axis and having longitudinally opposite bar ends;

a plurality of tool assemblies on the transfer bar and adapted to grip and hold the workpiece;

a pair of stationary frames spaced apart along a Y axis generally parallel to the bar axis, juxtaposed with the ends, and longitudinally flanking the bar;

a pair of X slides each displaceable in a horizontal X direction perpendicular to the Y axis and each on a respective one of the frames;

respective primary mounts on the X slides and each carrying a respective end of the bar with the bar being longitudinally movable at each of its ends in the respective primary mount; and respective Y actuators connected between the X and Y slides for shifting the bar relative to the X slides along the bar axis.

9. The apparatus defined in claim 8, wherein the Y actuators are pneumatic piston/cylinder units.

10. The apparatus defined in claim 9, further comprising:

control means for pressurizing one of the pneumatic piston/cylinder units to urge the bar toward the other pneumatic piston/cylinder unit and simultaneously depressurizing the other unit to allow free movement of the respective bar end in the respective slide.

11. An apparatus for moving a workpiece in a press installation, the apparatus comprising:

a transfer bar extending along a longitudinal bar axis and having longitudinally opposite bar ends;

a plurality of tool assemblies on the transfer bar and adapted to grip and hold the workpiece;

a pair of stationary frames spaced apart along a Y axis generally parallel to the bar axis, juxtaposed with the ends, and longitudinally flanking the bar;

a pair of X slides each displaceable in a horizontal X direction perpendicular to the Y axis and each on a respective one of the frames; and respective primary mounts on the X slides and each carrying a respective end of the bar with the bar being longitudinally movable at each of its ends in the respective primary mount, each primary mount end being rotatable about a vertical axis in the respective X slide.

12. The apparatus defined in claim 11, further comprising:

respective secondary mounts carried on the primary mounts, rotatable about respective horizontal axes relative to the respective primary mounts, and fitted with the respective bar ends.

13. The apparatus defined in claim 12, further comprising:

respective primary drives for rotating the primary mounts about the vertical axes on the respective slides; and respective secondary drives for rotating the secondary mounts about horizontal axes on the respective primary drives.

14. The apparatus defined in claim 12, wherein each of the bars is rotatable about the bar axis in the respective secondary mount.

15. The apparatus defined in claim 12, further comprising:

respective couplings at the bar end releasably connecting the respective par ends to the respective secondary mounts.

16. The apparatus defined in claim 15, wherein each coupling includes a socket fitting and a plug fitting, one of the fittings being on the secondary mount and the other fitting on the respective bar end, the one fitting being rotatable about the bar axis on the secondary mount.

* * * * *